US005765634A

United States Patent [19]

Martins

[11] Patent Number: 5,765,634

[45] Date of Patent: Jun. 16, 1998

[54] FLAT HEAT EXCHANGER TUBE WITH A CENTRAL PARTITION

[75] Inventor: Carlos Martins, Montfort l'Amaury, France

[73] Assignee: Valeo Thermique Moteur, Le Mesnil-Saint-Denis, France

[21] Appl. No.: 869,814

[22] Filed: Jun. 5, 1997

[30] Foreign Application Priority Data

Jun. 5, 1996 [FR] France ..... 96.06932

[51] Int. Cl.[6] ..... F28F 1/00

[52] U.S. Cl. ..... 165/177; 29/890.053; 165/178; 165/183

[58] Field of Search ..... 165/177, 178, 165/179, 181, 182, 183, 184; 29/890.053

[56] References Cited

U.S. PATENT DOCUMENTS

| | | | |
|---|---|---|---|
| 2,245,102 | 6/1941 | Field | 29/890.053 X |
| 2,655,181 | 10/1953 | Cooper | 29/890.053 X |
| 4,024,619 | 5/1977 | Jonason . | |
| 4,766,953 | 8/1988 | Grieb et al. | 165/177 |
| 5,186,250 | 2/1993 | Ouchi et al. | 165/177 |
| 5,186,251 | 2/1993 | Joshi | 165/183 X |
| 5,441,106 | 8/1995 | Yukitake | 165/177 X |
| 5,511,613 | 4/1996 | Mohn et al. | 165/177 |
| 5,579,837 | 12/1996 | Yu et al. | 165/177 X |
| 5,689,881 | 11/1997 | Kato | 165/177 X |

FOREIGN PATENT DOCUMENTS

| | | | |
|---|---|---|---|
| 302 232 | 2/1989 | European Pat. Off. . | |
| 2 261 819 | 9/1975 | France . | |
| 6123571 | 5/1994 | Japan | 165/177 |

*Primary Examiner*—Denise L. Ferensic
*Assistant Examiner*—Christopher Atkinson
*Attorney, Agent, or Firm*—Morgan & Finnegan, L.L.P.

[57] ABSTRACT

A fabricated flat heat exchanger tube, applicable especially to cooling radiators for motor vehicle engines, is divided into two by a reinforcing partition. The partition consists of a pleat extending into the interior of the tube and formed in the sheet metal strip from which the tube is fabricated. The regions of the strip which are adjacent to the pleat constitute a first main wall of the tube, while its two terminal or marginal regions are bent back at 180 degrees into the interior of the tube from the adjacent regions that constitute the second main wall of the tube. These terminal regions are brazed sealingly to the pleat. The outer dimensions of the tube in transverse cross section, and the quality of brazing, do not depend on the exact width of strip.

9 Claims, 1 Drawing Sheet

FLAT HEAT EXCHANGER TUBE WITH A CENTRAL PARTITION

FIELD OF THE INVENTION

This invention relates to flat tubes, used in heat exchangers for flow of fluid through the tubes, the tube having a central partition dividing it into two flow channels. Such tubes are used, in particular, in cooling radiators for motor vehicle engines.

More particularly, the invention relates to such tubes which are fabricated by longitudinal bending and brazing of a sheet metal strip having a first face defining the outside surface of the tube, the said first face being coated with a braze metal, the tube comprising a first main wall and a second main wall opposite the first main wall, the said main walls being substantially flat and parallel to each other and being joined together through two complementary wall portions so as to define a closed profile, the first main wall being formed from a middle region of the width of the strip, and the second main wall being formed from two intermediate regions which lie on either side of the said middle region, the said intermediate regions being brought into juxtaposition substantially in a common plane, and two terminal regions of the said strip, each said terminal region being adjacent to a respective said intermediate region and being bent back with respect to the intermediate regions towards the inside of the tube and secured by brazing to the inner surface of the said middle region.

BACKGROUND OF THE INVENTION

Tubes of the above type are normally arranged in one or more rows, with the tubes in any one row being aligned with each other parallel to their thickness, that is to say in a direction at right angles to their main walls. Each tube joins two fluid headers together, so as to enable the fluid to flow in one or more passes between the two fluid headers while exchanging heat with a stream of air which is passed through the bundle of tubes, and which sweeps the outer surface of each tube.

In a known tube of this kind, the terminal, or marginal, regions of the sheet metal strip have a width which corresponds to the internal thickness of the tube, and are bent back at right angles with respect to the intermediate regions, so that the free edge of the terminal regions are engaged on the internal surface of the first main wall of the tube. These terminal or marginal portions, on which the brazed metal coatings therefore face towards each other, are secured together by brazing to each other and to the first main wall. In this way, a reinforcing partition or spacer element is formed within the tube, dividing the interior of the tube into two separate parallel ducts.

It will be clear that, in a tube having the structure just described, the form and dimensions of the transverse cross-section of the tube impose limitations on the width of the flat metal strip from which the tube is fabricated. It is therefore not possible to start with a strip of standard size, unless it is re-cut, if tubes of different tubes of dimensions are required. In addition, the required width of the strip must be precisely observed, and this increases its manufacturing cost or leads to wastage.

Such known types of tube as are discussed above are shown in FIGS. 3 and 4 of the accompanying drawings. Part of one of these tubes in one form is shown in FIG. 3. In this tube, one of the terminal regions, shown at 114, is bent back at right angles with respect to the adjacent region 112 of the sheet metal strip. The terminal region 114 is abutted normally on the internal face of the first main wall 107, while the other terminal region 113 is shorter, and is spaced away from the wall 107. The region 113 therefore plays no part in the reinforcement of the tube. In addition, it is difficult to ensure that the adjacent region 111 will lie in the same plane as the region 112 so as to constitute satisfactorily the second main wall of the tube.

In the version shown in FIG. 4, the region 113 does have the required length, but the region 114 is now too long. The region 114 therefore lies obliquely to the main walls 107 and 111, 112 of the tube. Thus in this case, the regions 113 and 114 are not properly abutted on each other, so that again, they do not provide the required reinforcement for the tube. In addition, there may be poor sealing, leading to leakage.

DISCUSSION OF THE INVENTION

The object of the present invention is to overcome the above mentioned drawbacks, and to enable a flat heat exchanger tube to be made to a predetermined size, starting with a sheet metal strip the width of which can be permitted to vary to some extent; and in conjunction with this, to enable the tubes to be made to slightly different sizes from a sheet metal strip of standard width.

According to the invention in a first aspect, a flat tube for the flow of a fluid in a heat exchanger, in particular a cooling radiator for the engine of a motor vehicle, the tube being formed by longitudinal bending of a sheet metal strip having a first face defining the outside surface of the tube, the said first face being coated with a braze metal, the tube comprising a first main wall and a second main wall opposite the first main wall, the said main walls being substantially flat and parallel to each other and being joined together through two complementary wall portions so as to define a closed profile, the first main wall being formed from a middle region of the width of the strip, and the second main wall being formed from two intermediate regions which lie on either side of the said middle region, the said intermediate regions being brought into juxtaposition substantially in a common plane, and two terminal regions of the said strip, each said terminal region being adjacent to a respective said intermediate region and being bent back with respect to the intermediate regions towards the inside of the tube being secured by brazing to the inner surface of the said middle region, is characterised in that the first main wall consists of two zones of the middle region lying laterally on either side of a pleat which extends into the interior of the tube, with the said terminal regions, bent back at substantially 180 degrees, being engaged on the said pleat.

The pleat is preferably located halfway along the width of the first main wall of the tube.

The said pleat preferably has a U-shaped transverse cross section defining branches which are abutted together and which extend at right angles to the said main walls, with the said terminal regions being engaged on the base portion of the U. According to a preferred feature of the invention, each terminal region is bent back into a U-shape with respect to the adjacent intermediate region, and engages on the said pleat through the base portion of the U.

In preferred embodiments, the base portion of the U of each terminal region is in contact with that of the other terminal region and with the said pleat, these three elements defining together a cavity adapted to become filled with braze metal during melting of the said coating that is present on the terminal regions.

Preferably, each said terminal region is bent back flat on the adjacent intermediate region, the terminal region and the intermediate region being in mutual contact through the second surface of the strip.

The said complementary wall portions preferably have a convex curved profile, which is preferably substantially semicircular.

According to the invention in a second aspect, a method of making a tube according to the invention in its first aspect comprises the successive steps of:

(a) bending the said strip longitudinally so as to form the said pleat, the remainder of the strip lying substantially in a plane on either side of the pleat;

(b) bending the terminal regions of the strip, on the side of the said plane on which the pleat lies, at a predetermined distance from the pleat along the width of the strip; and (c) curving the strip, at a predetermined distance from each side of the pleat, so as to form the complementary wall portions of the tube, with the said intermediate regions pivoting substantially through 180 degrees so as to bring the terminal regions of the strip into contact with the pleat.

Further features and advantages of the invention will appear more clearly on a reading of the following detailed description of some preferred embodiments of the invention, which is given by way of non-limiting example only and with reference to the accompanying drawings.

DESCRIPTION OF PREFERRED EMBODIMENTS OF THE INVENTION

Figure 1:
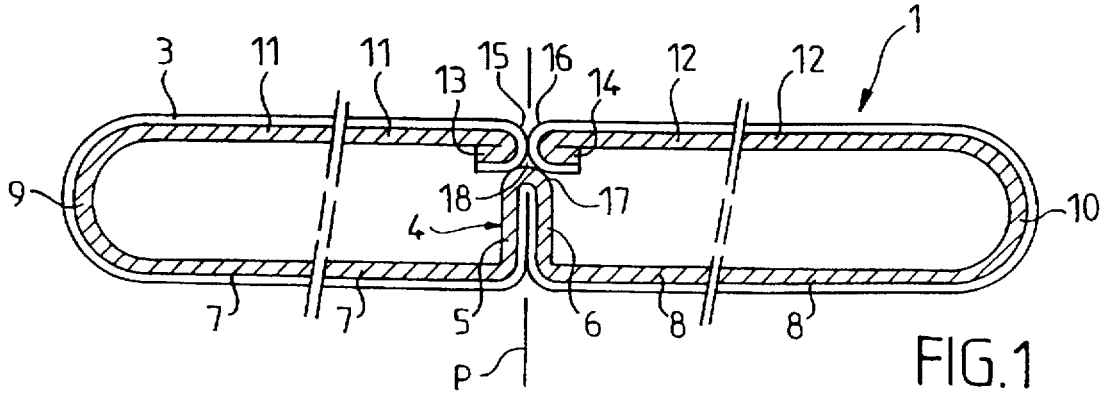
FIG. 1 is a partial view in transverse cross-section showing a tube in one form in accordance with the invention, prior to being brazed.
Figure 5:
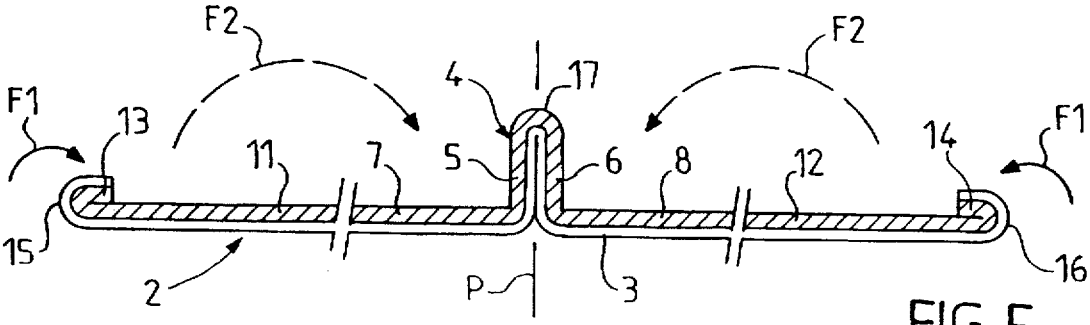
FIG. 5 is a partial view in transverse cross-section, showing the strip which is used in making the tube in accordance with the invention as shown in FIG. 1, FIG. 5 showing this strip in the course of the bending operation.

Reference is first made to FIG. 1, which shows in transverse cross-section a flat tube 1 which is formed by a bending operation on the strip 2, of metal plate, which is shown in FIG. 5. The face of the strip 2 which faces towards the bottom in FIG. 5 has a coating 3 of a braze metal, which covers the whole periphery of the transverse cross-section of the tube 1. Halfway along its width, the strip 2 is formed with a pleat 4 which extends into the tube as shown in FIG. 1. In transverse cross-section this pleat is U-shaped, having branches 5 and 6 which are abutted together, and which are bent back at right angles with respect to the adjacent regions 7 and 8 of the strip. In FIG. 1, these regions 7 and 8 lie in a common plane, so as to constitute a first main wall of the tube. They are joined respectively, by complementary wall portions 9 and 10 which are curved into semicylindrical form, to further flat regions 11 and 12 which constitute the second main wall of the tube, parallel to the first main wall 7, 8. Thus the periphery of the tube consists of the two main walls 7, 8 and 11, 12 which are flat and parallel to each other, together with the two complementary curved wall portions 9 and 10.

Terminal or marginal regions 13 and 14 of the strip 2, which are adjacent to the regions 11 and 12 respectively, are bent back at 180 degrees with respect to the latter inside the tube.

As can be seen in FIG. 1, these terminal regions 13 and 14, together with the wall portions 11 and 12, define respective U-shaped profiles having base portions 15 and 16. These base portions 15 and 16 are in contact with each other through the braze metal coating 3, while each base portion 15, 16 is in contact with the base portion 17 of the U-shaped pleat 4. There is a cavity 18 between the three adjacent portions 15, 16 and 17. This cavity 18 has a transverse cross-section in the form of a triangle with curved sides, which becomes filled with braze metal during the brazing operation in which the braze metal is melted. At the same time, melting of the braze metal covers the surfaces of the branches 5 and 6 which face towards each other, thus ensuring rigidity of the pleat 4. In this way the pleat 4 and the terminal regions 13 and 14 together constitute a partition or spacer element of high integrity, with perfect sealing of the tube where the three above-mentioned base portions are joined together. The fact that this sealing zone is adjacent to the outside of the tube also facilitates the operations of preparing for the brazing operation, i.e. degreasing, application flux, and storing. The aspect of the tube prior to the brazing operation is also thereby easily controlled.

Figure 2:
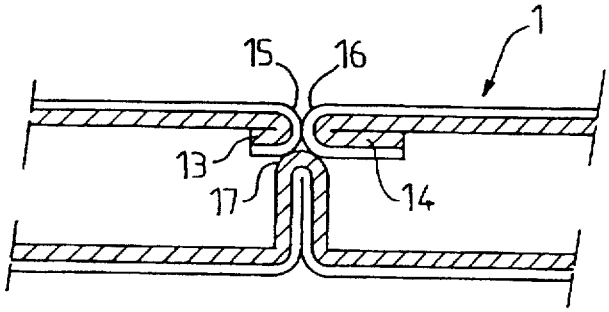
FIG. 2 is similar to the middle part of FIG. 1, except that FIG. 2 shows a modified embodiment in which the tube is made from a slightly wider strip.
Figure 3:
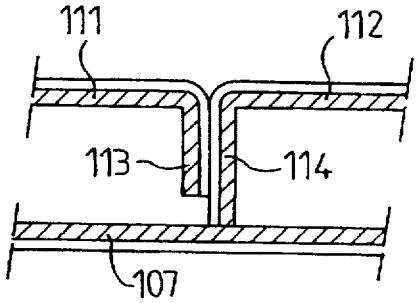
FIGS. 3 and 4, to which reference has already been made, are views in transverse cross-section similar to FIG. 2 but showing tubes in accordance with the prior art.
Figure 4:
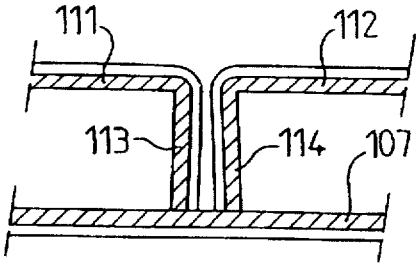

The tube in FIG. 1 is rigorously symmetrical with respect to the plane, indicated at P, which passes firstly between the branches 5 and 6 of the pleat 4 and secondly between the base portions 15 and 16. Referring now to FIG. 2, in this particular embodiment this symmetry is broken due to the fact that the terminal region 14 is wider than the terminal region 13, the initial workpiece, i.e. the flat strip 2, being itself slightly wider in this case than the band shown in FIG. 5. It will be realised that this increase in width in no way affects the outside dimensions of the finished tube; nor does it affect the form of the relative positions of the three base portions 15, 16 and 17 of the U-shaped elements. This increased width does not therefore affect the quality of the above mentioned spacer element.

In a preferred method of making the tube according to the invention, for example the tube shown in FIG. 1 or FIG. 2, the pleat 4 is formed by carrying out a triple longitudinal bending operation on the strip 2, after which the terminal regions 13 and 14 are bent back at 180 degrees with respect to the adjacent regions 11 and 12, as indicated by the arrows F1 in FIG. 5. The regions 11 and 12 are then raised by causing them to pivot through 180 degrees with respect to the regions 7 and 8 respectively, as indicated by the arrows F2 in FIG. 5. This operation is preferably carried out by rolling the regions 9 and 10 into the form of half cylinders. Bending of the terminal regions 13 and 14 is carried out in such a way that the base portions 15 and 16 are formed at a predetermined distance from the plane P which is defined by the branches 5 and 6, as a result of which any excess or shortfall in the width of the strip 2 only affects the width of the terminal regions 13 and 14, and has no effect on the outside dimensions of the tube.

What is claimed is:

1. A flat tube for the flow therein of a fluid in a heat exchanger, the tube being formed by bending a sheet metal strip along the length of the strip, the tube having an outside surface and a layer of braze metal on said outside surface, said layer having been pre-applied on the corresponding surface of said strip, the tube comprising: a first main wall; a second main wall parallel to the first main wall, said main walls being substantially flat; and two complementary side wall portions joining said main walls together so as to define a closed profile of the tube, said strip defining over its width a middle region and two intermediate regions on either side of said middle region, the first main wall of the tube being formed from said middle region, said second main wall of the tube comprising two wall portions each formed from a respective one of said intermediate regions, with said wall portions of the second main wall being juxtaposed in substantially a common plane, the second main wall further having two terminal regions, each terminating a respective one of its said wall portions, each said terminal region being bent back from the associated wall portion into the interior of the tube, the first main wall defining an internal face thereof brazed to said terminal regions, wherein said first main wall defines a pleat extending into the interior of the tube, and two zones, formed from said middle region of the strip and lying on either side of said pleat, said terminal regions being bent back substantially at 180 degrees and being engaged on said pleat.

2. A tube according to claim 1, wherein the pleat is halfway along the width of the first main wall.

3. A tube according to claim 1, wherein the pleat has a U-shaped transverse cross-section defining two branches abutted with each other and extending at right angles to said main walls, and further defining a base portion of the pleat, said terminal regions being engaged on said base portion.

4. A tube according to claim 1, wherein each said terminal region is bent back so as to define a U with respect to the adjacent wall portion of the second main wall, each said U having a base portion bearing on said pleat.

5. A tube according to claim 4, wherein said base portion of the U of each terminal region is in contact with the base portion of the other terminal region and with the pleat, whereby said base portions and pleat define a cavity between them, the terminal portions and the pleat being brazed together by melting of said braze metal on the terminal portions, said braze metal filling said cavity.

6. A tube according to claim 4, wherein each said terminal region is bent back flat on the adjacent intermediate region, with the terminal region and the intermediate region being in mutual contact.

7. A tube according to claim 1, wherein said complementary end wall portions have a convex curved profile.

8. A tube according to claim 7, wherein said profile is substantially semi-circular.

9. A method of making a tube according to claim 1, comprising the successive steps of;

(a) taking a strip of sheet metal, having a first face, a second face opposite to the first face, and a layer of braze metal coated on said first face, the strip defining across its width: terminal regions along its longitudinal edges; a middle region; and an intermediate region between the middle region and each said terminal region; and bending said strip longitudinally so as to form said pleat in the middle region, with the remainder of the strip extending in substantially one plane on either side of the pleat;

(b) bending back the terminal regions of the strip on the same side of said plane as the pleat, at a predetermined distance from the pleat widthwise of the strip; and (c) bending the strip in a curve at a predetermined distance from each side of the pleat, thereby forming said complementary wall portions of the tube, with said intermediate regions pivoting substantially through 180 degrees so as to put said terminal regions into contact with the pleat.

* * * * *